US012201138B2

(12) United States Patent
Bass et al.

(10) Patent No.: US 12,201,138 B2
(45) Date of Patent: Jan. 21, 2025

(54) SEAM-SEALING ADHESIVE APPLICATION APPARATUS AND ASSOCIATED METHOD

(71) Applicant: R. J. REYNOLDS TOBACCO COMPANY, Winston-Salem, NC (US)

(72) Inventors: Steven P. Bass, Raleigh, NC (US); Paul Stuart Chapman, Winston-Salem, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 1731 days.

(21) Appl. No.: 14/824,615

(22) Filed: Aug. 12, 2015

(65) Prior Publication Data

US 2016/0050970 A1 Feb. 25, 2016

Related U.S. Application Data

(60) Provisional application No. 62/039,703, filed on Aug. 20, 2014.

(51) Int. Cl.
*A24C 5/00* (2020.01)
*A24C 5/24* (2006.01)

(52) U.S. Cl.
CPC ..... *A24C 5/00* (2013.01); *A24C 5/007* (2013.01); *A24C 5/24* (2013.01)

(58) Field of Classification Search
None
See application file for complete search history.

(56) References Cited

U.S. PATENT DOCUMENTS

| | | | | |
|---|---|---|---|---|
| 2,809,640 | A | 10/1957 | Oldenkamp | |
| 3,143,148 | A * | 8/1964 | Worn | B31C 3/00 138/144 |
| 3,288,147 | A | 11/1966 | Molins et al. | |
| 3,308,600 | A | 3/1967 | Erdmann et al. | |
| 3,448,721 | A | 6/1969 | Morris | |
| 3,668,045 | A | 6/1972 | Molins | |
| 3,915,176 | A | 10/1975 | Heitmann et al. | |
| 4,024,012 | A | 5/1977 | Sigmon | |

(Continued)

FOREIGN PATENT DOCUMENTS

| | | |
|---|---|---|
| EP | 2 177 118 A1 | 4/2010 |
| GB | 1 575 910 A | 10/1980 |

*Primary Examiner* — Phu H Nguyen
(74) *Attorney, Agent, or Firm* — Womble Bond Dickinson (US) LLP

(57) ABSTRACT

An apparatus and method for forming a smoking article rod is provided. A forming device is configured to engage a continuous stream of a smokable filler material with a first surface of a longitudinally-continuous web of a wrapping material, the web having first and second edge portions extending along the web, and a second surface opposing the first surface. A wrapping device is configured to longitudinally overlap the first and second edge portions such that the first surface about the first edge portion extends over the second surface about the second edge portion, to contain the smokable filler material within the web. An adhesive applicator device is configured to apply an adhesive material to the second surface about and longitudinally along the second edge portion, between the overlapped edge portions, prior to the wrapping device engaging the overlapped edge portions, with the adhesive material therebetween, to form a sealed seam.

16 Claims, 5 Drawing Sheets

(56) References Cited

U.S. PATENT DOCUMENTS

| | | | | |
|---|---|---|---|---|
| 4,077,415 | A | 3/1978 | Preston et al. | |
| 4,236,535 | A | 12/1980 | Schmidt et al. | |
| 4,237,907 | A | 12/1980 | Pawelko et al. | |
| 4,249,545 | A * | 2/1981 | Gretz | A24C 5/3418 131/281 |
| 4,280,187 | A | 7/1981 | Reuland et al. | |
| 4,281,670 | A | 8/1981 | Heitmann et al. | |
| 4,291,713 | A | 9/1981 | Frank | |
| 4,340,074 | A | 7/1982 | Tudor | |
| 4,361,156 | A | 11/1982 | Hall | |
| 4,431,010 | A | 2/1984 | Seragnoli | |
| 4,474,190 | A | 10/1984 | Brand | |
| 4,500,770 | A | 2/1985 | Vock et al. | |
| 4,565,202 | A | 1/1986 | Seragnoli et al. | |
| 4,574,816 | A | 3/1986 | Rudszinat | |
| 4,583,558 | A | 4/1986 | Luke | |
| 4,600,027 | A | 7/1986 | Houck et al. | |
| 4,736,754 | A | 4/1988 | Heitmann et al. | |
| 4,781,203 | A | 11/1988 | La Hue | |
| 4,781,204 | A | 11/1988 | Barbe et al. | |
| 4,825,883 | A | 5/1989 | Hinz et al. | |
| 4,827,947 | A | 5/1989 | Hinz | |
| 4,841,993 | A | 6/1989 | Hinz et al. | |
| 4,844,100 | A | 7/1989 | Holznagel | |
| 4,878,506 | A | 11/1989 | Pinck et al. | |
| 4,889,140 | A | 12/1989 | Lorenzen et al. | |
| 4,979,521 | A | 12/1990 | Davis et al. | |
| 5,012,823 | A | 5/1991 | Keritsis et al. | |
| 5,060,665 | A | 10/1991 | Heitmann | |
| 5,060,668 | A | 10/1991 | Weinhold | |
| 5,156,169 | A | 10/1992 | Holmes et al. | |
| 5,191,906 | A | 3/1993 | Myracle, Jr. | |
| 5,479,947 | A | 1/1996 | Dyett | |
| 5,492,568 | A | 2/1996 | Warmerdam et al. | |
| 5,690,125 | A | 11/1997 | Niemann et al. | |
| 5,743,275 | A | 4/1998 | Dawson et al. | |
| 6,206,963 | B1 | 3/2001 | Abrahams | |
| 6,360,751 | B1 | 3/2002 | Fagg et al. | |
| 6,526,985 | B1 | 3/2003 | Dombek | |
| 6,532,966 | B1 | 3/2003 | Dombek | |
| 6,647,878 | B2 | 11/2003 | Blau et al. | |
| 6,675,811 | B2 | 1/2004 | Dombek | |
| 6,848,449 | B2 | 2/2005 | Kitao et al. | |
| 6,880,559 | B2 | 4/2005 | Dombek | |
| 6,904,917 | B2 | 6/2005 | Kitao et al. | |
| 7,089,944 | B2 | 8/2006 | Schlisio | |
| 7,210,486 | B2 | 5/2007 | Hartmann | |
| 7,234,471 | B2 * | 6/2007 | Fitzgerald | A24D 1/02 131/365 |
| 7,275,548 | B2 | 10/2007 | Hancock et al. | |
| 7,275,549 | B2 | 10/2007 | Hancock et al. | |
| 7,296,578 | B2 | 11/2007 | Read, Jr. | |
| 7,434,585 | B2 | 10/2008 | Holmes | |
| 2003/0136419 | A1 | 7/2003 | Muller | |
| 2003/0205235 | A1 | 11/2003 | Draghetti | |
| 2004/0231685 | A1 | 11/2004 | Patel et al. | |
| 2005/0194014 | A1 | 9/2005 | Read, Jr. | |

* cited by examiner

SEAM-SEALING ADHESIVE APPLICATION APPARATUS AND ASSOCIATED METHOD

CROSS-REFERENCE TO RELATED APPLICATIONS

This application claims the benefit of U.S. Provisional Patent Application No. 62/039,703, filed Aug. 20, 2014, the disclosure of which is incorporated herein by reference in its entirety.

BACKGROUND

1. Field of the Disclosure

The present disclosure relates to products made or derived from tobacco, or that otherwise incorporate tobacco, and are intended for human consumption; and more particularly, to an apparatus and method for forming a smoking article rod, involving a seam-sealing adhesive application apparatus used in the manufacture of tobacco rods of smoking articles.

2. Disclosure of Related Art

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999); which is incorporated herein by reference. A traditional type of cigarettes is employed by a smoker by lighting one end thereof and burning the tobacco rod. The smoker then receives mainstream smoke into his/her mouth by drawing on the opposite end (e.g., the filter end or mouth end) of the cigarette. Various components and ingredients suitable for cigarette manufacture are set forth, for example, in U.S. Pat. No. 7,234,471 to Fitzgerald et al., which is incorporated herein by reference.

During manufacture of such smoking articles as cigarettes, the produced rod portions forming the cigarette may require that a particular rod material be lengthwise-wrapped by a length of a sheet or web of a wrapping material. For example, a tobacco rod may be formed by lengthwise wrapping a longitudinally-continuous web of a cigarette wrapping paper about a continuous stream of a tobacco material, and then sealing overlapping lateral edge portions of the web of the cigarette wrapping paper so as to contain the tobacco material therein. Often, an adhesive material is applied between the overlapped lateral edge portions of the web of cigarette wrapping paper so as to facilitate the formation of the seal or side seam. In this manner, a tobacco rod may be formed. Similar processes may be conducted, for example, to produce a filter rod for the smoking article/cigarette. The adhesive material may vary, and adhesive materials suitable for the application(s) herein are set forth, for example, in U.S. Pat. No. 5,492,568 to Warmerdam et al., which is incorporated herein by reference. Suitable types of cigarette-making machines capable of implementing such a process are set forth, for example, in U.S. Pat. No. 5,479,947 to Dyett and U.S. Pat. No. 5,743,275 to Dawson et al., which is incorporated herein by reference. Certain apparatuses and method for wrapping cigarette rods and including particular modifications for certain purposes are set forth, for example, in U.S. Pat. No. 4,979,521 to Davis et al.; U.S. Pat. No. 5,060,665 to Heitmann; and U.S. Pat. No. 7,275,549 to Hancock et al., which are incorporated herein by reference.

In particular instances, the adhesive material is applied to a surface of the web of the cigarette wrapping paper associated with the lateral edge portion overlapping or extending over the opposing lateral edge portion (i.e., the "inner" or wire-side surface of the one lateral edge portion of the cigarette wrapping paper extending over and facing the "outer" or felt-side surface of the opposing lateral edge portion of the cigarette wrapping paper). The adhesive material may often be applied via a nozzle such as set forth, for example, in U.S. Pat. No. 6,206,963 to Abrahams, which is incorporated herein by reference. However, since the longitudinally-continuous "bead" of the adhesive material applied to the wire-wide surface of the one lateral edge portion of the cigarette wrapping paper is often the only means for sealing the "side seam" of the cigarette rod, the bead must be carefully applied in order to ensure that the side seam is consistently sealed along the continuous cigarette rod. In some instances, such careful application may require an undesirably-reduced cigarette rod production speed, or otherwise undesirably limit the magnitude of the attainable cigarette rod production speed. In addition, the single bead applied to the wire-side surface of the one lateral edge portion may not form a sufficiently robust longitudinally-continuous side seam for the resulting cigarette rod.

As such, it would be highly desirable to provide a manner or method, and associated apparatus, for forming rod portions of smoking articles such as cigarettes, in a manner which may provide a more robust side seam of the formed rod portions. Further, it would be desirable for the cigarette rod formation process to be operable at a relatively high production speed for the cigarette rod portions, while also implementing suitable provisions for forming the more robust side seam of such cigarette rod portions.

BRIEF SUMMARY OF THE DISCLOSURE

The above and other needs are met by aspects of the present disclosure which, in one particular aspect, provides a method for forming a smoking article rod. Such a method comprises engaging a continuous stream of a smokable filler material with a first surface of a longitudinally-continuous web of a wrapping material, with the web having laterally-opposed first and second edge portions extending along the longitudinally-continuous web, and having a second surface opposing the first surface. The first and second edge portions are then longitudinally overlapped such that the first surface about the first edge portion extends over the second surface about the second edge portion, and so as to contain the smokable filler material within the longitudinally-continuous web. An adhesive material is then applied to at least the second surface about and longitudinally along the second edge portion, between the longitudinally-overlapped first and second edge portions, prior to engaging the longitudinally-overlapped first and second edge portions, with the adhesive material therebetween, to form a sealed seam and produce a longitudinally-continuous smoking article rod.

Another aspect of the disclosure provides an apparatus for forming a smoking article rod. Such an apparatus comprises a forming device configured to engage a continuous stream of a smokable filler material with a first surface of a longitudinally-continuous web of a wrapping material, with the web having laterally-opposed first and second edge portions extending along the longitudinally-continuous web, and having a second surface opposing the first surface. A wrapping device is configured to longitudinally overlap the first and second edge portions such that the first surface about the first edge portion extends over the second surface about the second edge portion, and so as to contain the smokable filler material within the longitudinally-continuous web. An adhesive applicator device is configured to apply an adhesive material to at least the second surface about and longitudinally along the second edge portion, between the longitudinally-overlapped first and second edge portions, prior to the wrapping device engaging the longitudinally-overlapped first and second edge portions, with the adhesive material therebetween, to form a sealed seam and produce a longitudinally-continuous smoking article rod.

Another aspect of the disclosure provides a method for forming a smoking article rod. Such a method comprises longitudinally overlapping laterally-opposed first and second edge portions of a longitudinally-continuous web of a wrapping material, wherein a first surface of the longitudinally-continuous web of the wrapping material has a continuous stream of a smokable filler material engaged therewith, such that the first surface about the first edge portion extends over a second surface of the longitudinally-continuous web of the wrapping material about the second edge portion, with the second surface opposing the first surface, and so as to contain the smokable filler material within the longitudinally-continuous web. An adhesive material is applied to at least the second surface about and longitudinally along the second edge portion, between the longitudinally-overlapped first and second edge portions, prior to engaging the longitudinally-overlapped first and second edge portions, with the adhesive material therebetween, to form a sealed seam and produce a longitudinally-continuous smoking article rod.

Yet another aspect of the disclosure provides an apparatus for forming a smoking article rod. Such an apparatus comprises a wrapping device configured to longitudinally overlap laterally-opposed first and second edge portions of a longitudinally-continuous web of a wrapping material, wherein a first surface of the longitudinally-continuous web of the wrapping material having a continuous stream of a smokable filler material engaged therewith, such that the first surface about the first edge portion extends over a second surface of the longitudinally-continuous web of the wrapping material about the second edge portion, with the second surface opposing the first surface, and so as to contain the smokable filler material within the longitudinally-continuous web. An adhesive applicator device is configured to apply an adhesive material to at least the second surface about and longitudinally along the second edge portion, between the longitudinally-overlapped first and second edge portions, prior to wrapping device engaging the longitudinally-overlapped first and second edge portions, with the adhesive material therebetween, to form a sealed seam and produce a longitudinally-continuous smoking article rod.

Aspects of the present disclosure thus address the identified needs and provide other advantages as otherwise detailed herein. It will be appreciated that this Summary is provided merely for purposes of summarizing some example aspects or combination of aspects so as to provide a basic understanding of some embodiments of the disclosure. As such, it will be appreciated that the above described example aspects are merely examples and should not be construed to narrow the scope or spirit of the disclosure in any way. It will be appreciated that the scope of the disclosure encompasses many potential aspects, some of which will be further described below, in addition to those here summarized.

BRIEF DESCRIPTION OF THE SEVERAL VIEWS OF THE DRAWINGS

Figure 1:
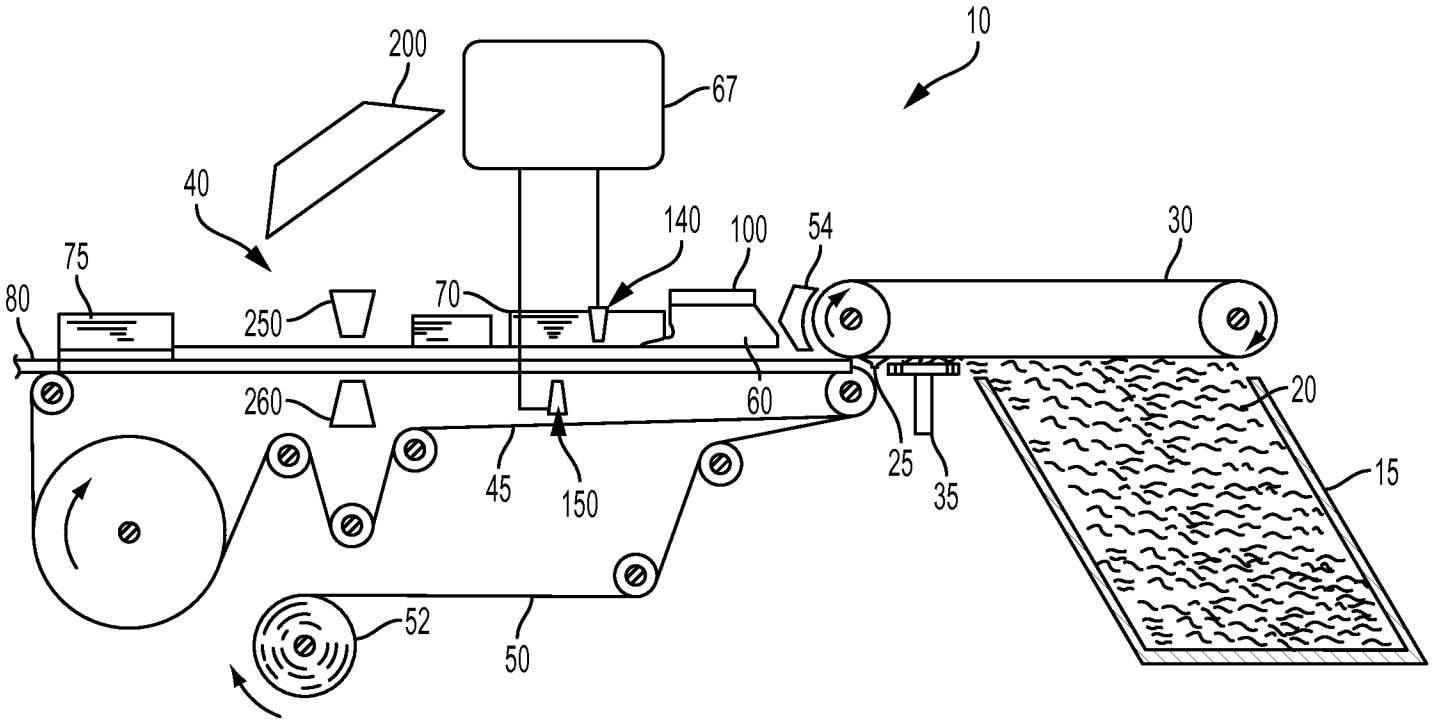
Figure 2:
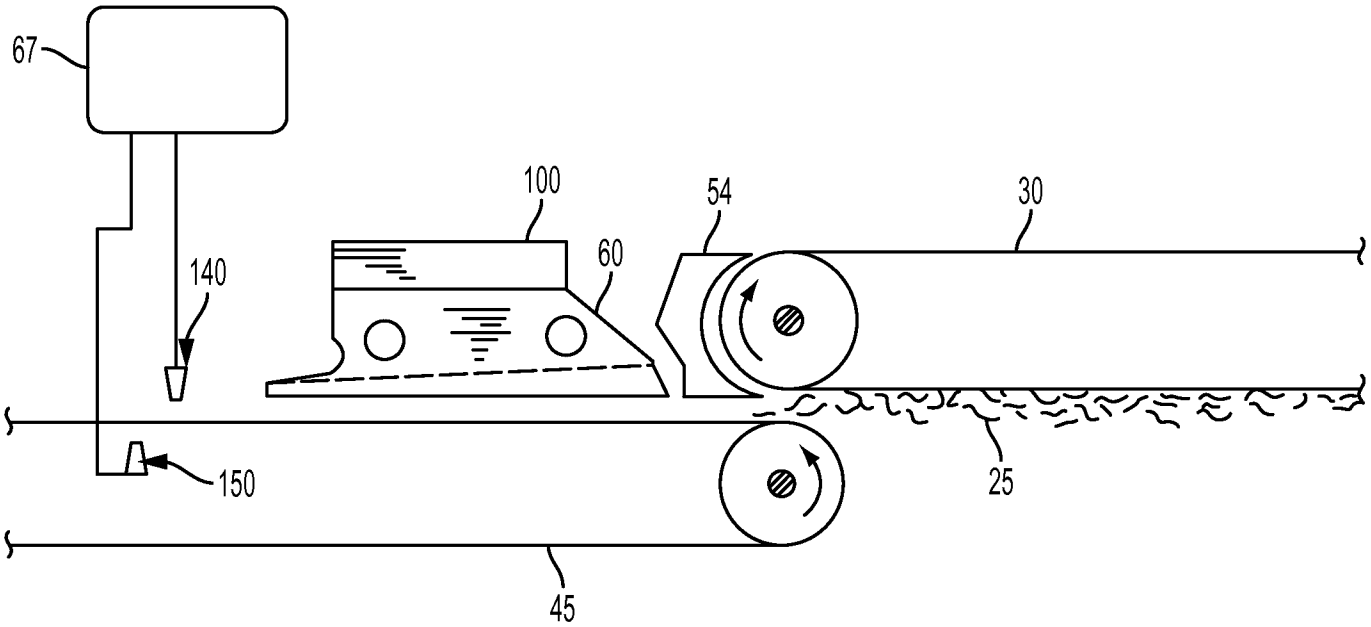
Figure 3:
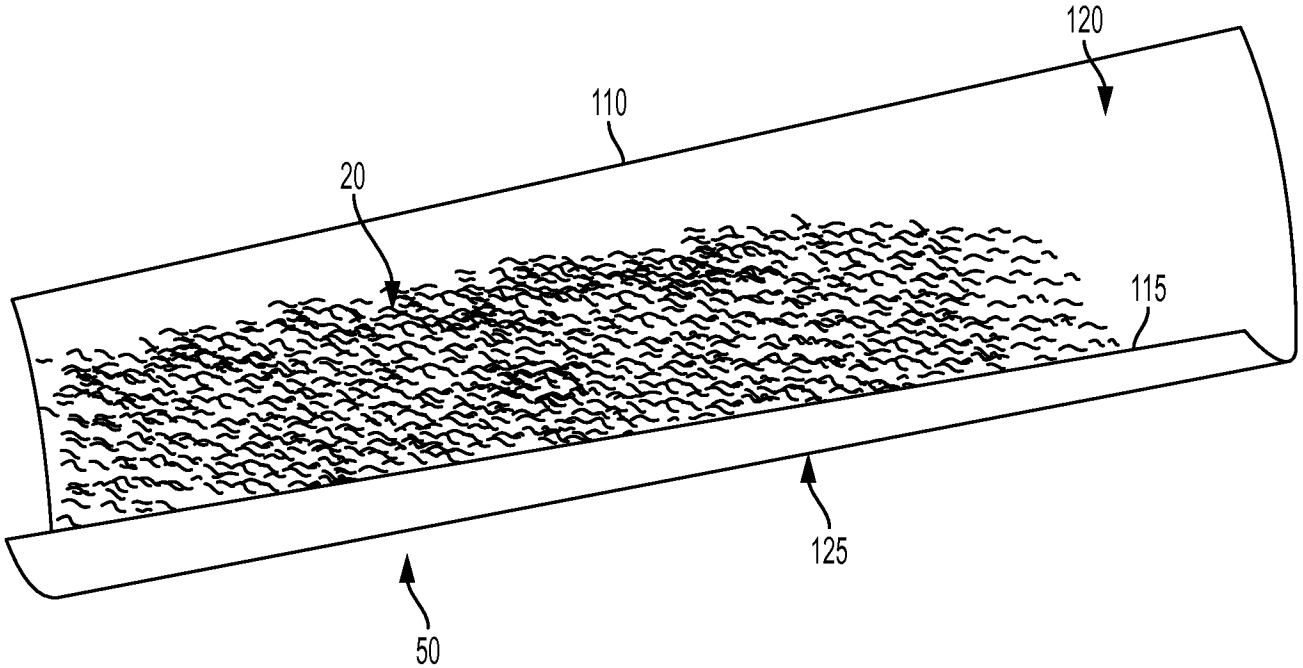
Figure 4:
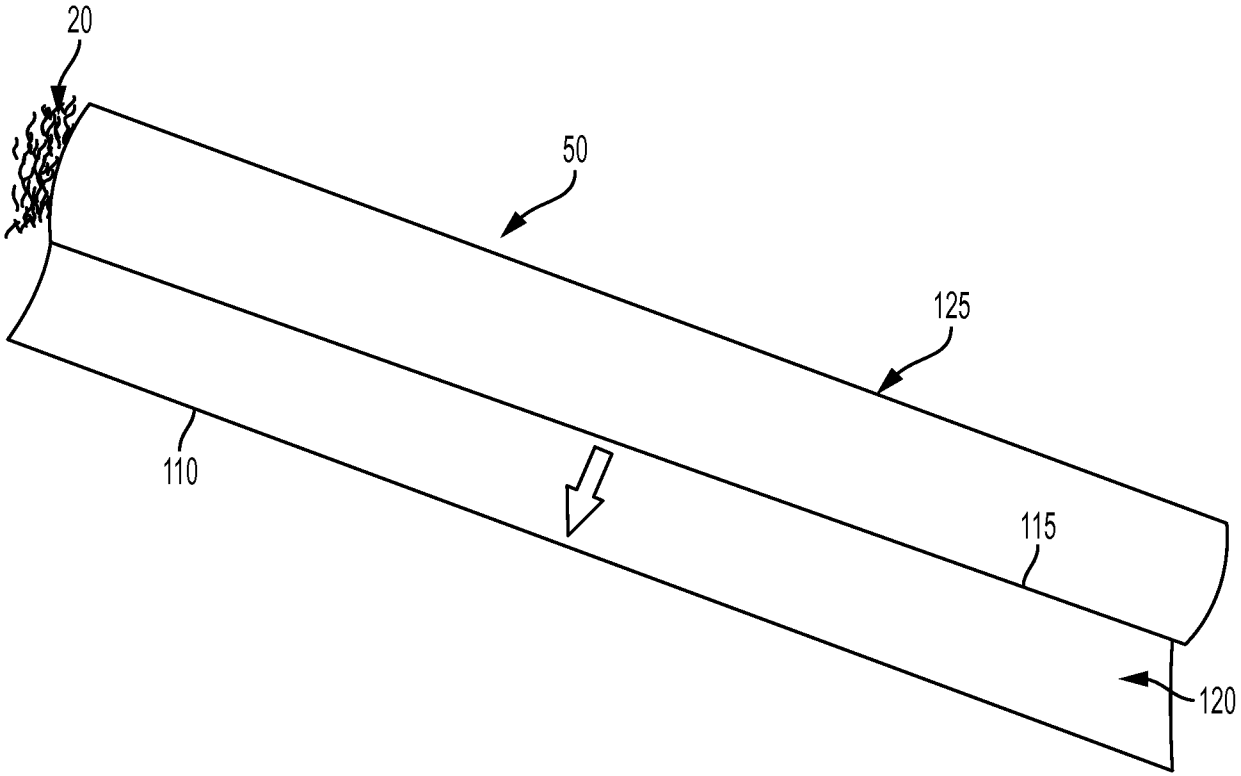
Figure 5:
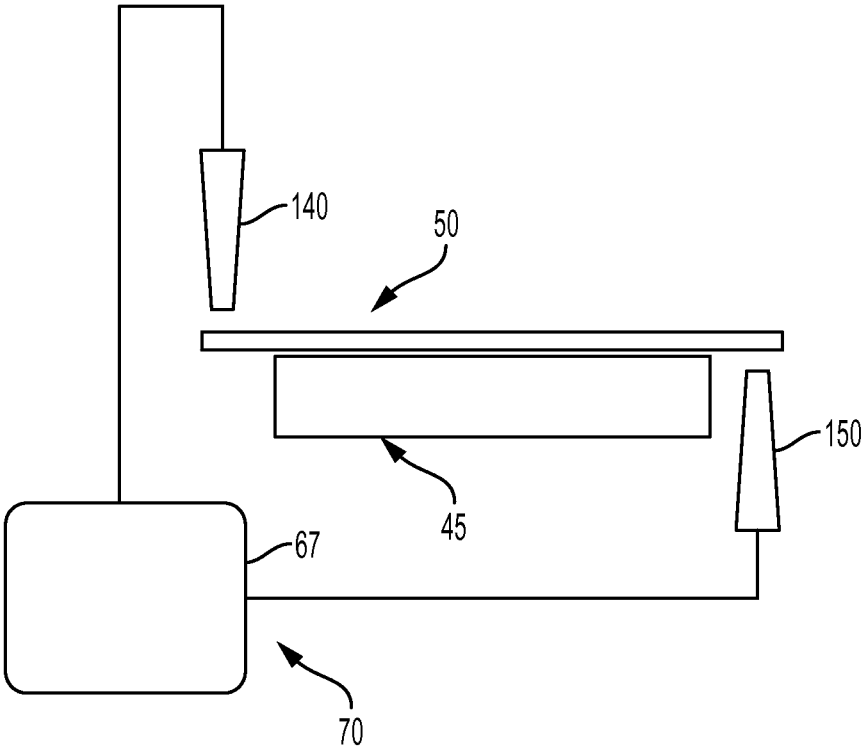

Having thus described the disclosure in general terms, reference will now be made to the accompanying drawings, which are not necessarily drawn to scale, and wherein:

FIG. 1 is a schematic illustration of an example apparatus for forming a smoking article rod in accordance with some example aspects of the present disclosure;

FIG. 2 is an enlarged schematic illustration of a portion of the apparatus for forming a smoking article rod shown in FIG. 1;

FIGS. 3 and 4 schematically illustrate the formation of a tobacco rod as one example of a smoking article rod formed in accordance with some example aspects of the present disclosure; and FIG. 5 schematically illustrates an example seam-sealing adhesive application apparatus that may be implemented in an apparatus for forming a smoking article rod in accordance with some example aspects of the present disclosure.

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

A smoking article (i.e., cigarette) rod making machine useful, at least in part, for implementing aspects of the present disclosure may be, for example, of the type commercially available from Molins PLC or Hauni-Werke Korber & Co. KG. For example, cigarette rod making machines of the type known as Mk8 (commercially available from Molins PLC) or PROTOS (commercially available from Hauni-Werke Korber & Co. KG) can be employed, and can be suitably modified in accordance with the present disclosure. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 7,210,486 to Hartman; U.S. Pat. No. 6,848,449 to Kitao et al.; U.S. Pat. No. 6,904,917 to Kitao et al.; U.S. Pat. No. 7,275,548 to Hancock et al.; U.S. Patent Application Pub. No. 2004/0231685 to Patel et al.; and PCT Application Pub. No. WO 02/19848; which are incorporated herein by reference. Such equipment incorporates nozzle assemblies and adhesive application features, and the operation thereof will be readily apparent to one skilled in the art.

Designs of various components of cigarette making machines, and the various material used to manufacture those components, will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,630,751 to Fagg et al.; and U.S. Patent Application Pub. No. 2003/0136419 to Muller; which are incorporated herein by reference. Automated cigarette making machines provide means for supplying or otherwise providing a formed continuous cigarette rod or smokable rod that can be subdivided into formed smokable rods of desired lengths.

Cigarette rods then most preferably have filter elements attached thereto, using known types of components, techniques and equipment. For example, the cigarette rod making machine can be suitably coupled to filter tipping machine, such as a machine available as a MAX, MAX S or MAX 80 Hauni-Werke Korber & Co. KG. See, also, for example, U.S. Pat. No. 3,308,600 to Erdmann et al. and U.S. Pat. No. 4,280,187 to Reuland et al; which are incorporated herein by reference. Various manners and methods for attaching filter elements to cigarette rods are set forth in U.S. Pat. No. 2,809,640 to Oldenkamp; U.S. Pat. No. 4,077,415 to Preston et al.; U.S. Pat. No. 4,236,535 to Schmidt et al.; U.S. Pat. No. 4,237,907 to Pawelko et al.; U.S. Pat. No. 4,340,074 to Tudor; U.S. Pat. No. 4,361,156 to Hall; U.S. Pat. No. 4,431,010 to Seragnoli; U.S. Pat. No. 7,296,578 to Read et al.; U.S. Pat. No. 4,583,558 to Luke; and U.S. Pat. No. 4,841,993 to Hinz et al. U.S. Pat. No. 7,089,944 to Schlisio; and U.S. Patent Application Pub. No. 2003/0205235 to Draghetti; which are incorporated herein by reference. As such, there are provided manners or methods for supplying a series of two-up filtered cigarette rods, each having two smokable rods and filter element of double length therebetween. Typically, a web of tipping paper is supplied, adhesive is applied to one side of the paper web, the web is cut to provide a segment of desired size, the segment is applied to the aligned dual filter and tobacco rods, and rotation of the components causes the paper segment to wrap around the filter and tobacco rod components.

Representative manners and methods for perforating manufactured cigarettes using laser systems are set forth in U.S. Pat. No. 4,281,670 to Heitmann et al.; U.S. Pat. No. 4,500,770 to Vock et al.; U.S. Pat. No. 4,565,202 to Seragnoli et al; U.S. Pat. No. 4,600,027 to Houck et al.; U.S. Pat. No. 4,825,883 to Hinz et al.; U.S. Pat. No. 4,889,140 to Lorenzen et al.; U.S. Pat. No. 5,060,668 to Weinhold; and U.S. Pat. Nos. 6,675,811 to Dombeck and 7,434,585 to Holmes; and EP Application No. 1072200 to Dombeck; which are incorporated herein by reference. Methods for rolling cigarettes in controlled manners (e.g., providing controlled rotation) in order that regions of those cigarettes can be appropriately treated (e.g., using laser systems) are set forth in U.S. Pat. No. 4,781,204 to Barbe et al.; U.S. Pat. No. 4,827,947 to Hinz; U.S. Pat. No. 5,690,125 to Niemann et al.; U.S. Pat. No. 6,526,985 to Bombeck; and U.S. Pat. No. 6,532,966 to Dombeck; which are incorporated herein by reference. As such, there is provided manners and methods for rotating each cigarette rod (e.g., each two-up filtered cigarette rod) about its longitudinal axis in a controlled manner.

As shown in FIG. 1, a cigarette making machine 10 may include a smokable fill material (i.e., tobacco) source, such as chimney 15, through which tobacco filler 20 or other smokable fill material is established in a continuous stream 25 on endless, porous, formable conveyor belt 30. As such, a source of tobacco filler or generally a tobacco material is established and maintained in order that a continuous stream of tobacco filler is supplied. The stream of tobacco filler is conveyed by belt 30 past trimming or equalizing device 35 in order to supply a uniform stream of the tobacco filler.

The cigarette making machine 10 may also include a garniture section 40. The garniture section includes an endless formable garniture conveyor belt 45. The garniture conveyor belt advances a longitudinally-continuous web 50 of a wrapping material, such as a cigarette paper, for example, from a bobbin 52. One end of the conveyor belt 45 is positioned adjacent to and below the exit end of the porous belt 30 in order that the continuous tobacco stream 25 is deposited on or otherwise engaged with a first surface 120 of the longitudinally-continuous web 50 of the wrapping material. Generally, the web 50 has laterally-opposed first 110 and second 115 edge portions extending along the longitudinally-continuous web, wherein the web also includes a second surface 125 opposing the first surface 120 (see, e.g., FIGS. 3 and 4).

A short tongue 54 located above belt 45 in the garniture section 40 is configured to begin to constrict the stream as the belt begins to form the filler stream and wrapper web 50 into a continuous rod. A tongue 60 located above belt 45 in the garniture section 40 constricts the stream 25 as the belt forms the filler stream and wrapper web 50 into the continuous rod. The tongue 60 extends to a point where the wrapper material is secured around the filler stream. That is, the tongue may be configured to longitudinally overlap the first and second edge portions of the wrapper web 50 such that the first surface about the first edge portion extends over the second surface about the second edge portion. In this manner, the smokable filler material is contained within the longitudinally-continuous web, as the wrapping material is secured around the filler stream.

The tongue and the belt 45 carrying the wrapper web 50 defines a passage which progressively decreases in cross-section in the direction of movement of the filler stream such that the filler stream progressively assumes a substantially circular cross-section, so as to form the filler stream into substantially the desired cross-section of the ultimate finished cigarette rod. A formed tobacco rod exits the tongue 60, and an adhesive material from a source 67 is applied using adhesive application device 70 to an exposed length of the web associated with the lap region or overlap between the opposed edge portions of the wrapper web 50. That is, an adhesive material is applied, for example, to at least the second surface about and longitudinally along the second edge portion, between the longitudinally-overlapped first and second edge portions, prior to engaging the longitudinally-overlapped first and second edge portions to form a sealed seam, as facilitated by the applied adhesive material therebetween.

In some aspects, the garniture section 40 may include a temperature control arrangement 200 (see, e.g., FIG. 1) configured to heat and/or cool one or more components of the garniture section 40. For example, the temperature control arrangement 200 may be configured to pre-heat the garniture section 40, or any component thereof, to a temperature considered to be an operating temperature, upon a cold start of the cigarette making machine 10. In other instances, the temperature control arrangement 200 may be configured to reduce or minimize temperature variations about the garniture section 40 or between components of the garniture section 40, to facilitate more consistent operation thereof. In some particular aspects, the temperature control arrangement 200, or at least a portion thereof, may be configured to heat and/or cool the source 67 of the adhesive material, the adhesive application device 70, and/or any component associated therewith (i.e., nozzles 140, 150 and/or any hoses or tubes extending between the source, the adhesive application device, and/or the nozzles) for delivering the adhesive material to the cigarette wrapping material, as discussed further herein, and/or to reduce or minimize temperature variations about the source 67, about the adhesive application device 70, and/or between the source, the adhesive application device, and/or other adhesive material application components, to facilitate more consistent and efficient operation thereof.

The longitudinally-continuous smoking article rod (i.e., tobacco rod) is thus formed by lapping the exposed length of wrapping material having the adhesive material applied thereto onto itself, and setting, curing, or activating the adhesive material, or otherwise causing the adhesive material to adhere to each of the overlapped portions of the wrapping material in the overlap region 75 in order to secure and seal the wrapping material around the tobacco filler, thereby forming a continuous cigarette rod 80. The rate at which the continuous rod is manufactured is essentially equal to the rate at which the stream 25 of tobacco filler is established and supplied. The continuous rod thus formed can be subsequently subdivided into a plurality of rod portions, each of a desired length, using known techniques. Although the circumference of typical cigarette rods can vary, typical rod circumferences range from about 19 mm to about 27 mm, and more typically from about 22 mm to about 25 mm.

According to particular aspects of the present disclosure, the longitudinally-continuous web 50 of a wrapping material may comprise, for example, a cigarette wrapping material, such as a cigarette paper, having a wire-side surface (i.e., the first surface of the longitudinally-continuous web) and a felt-side surface (i.e., the second surface of the longitudinally-continuous web). In such instances, in the process of longitudinally overlapping the first and second edge portions, the wire-side surface of the cigarette wrapping paper about the first edge portion is manipulated to extend or lap over the felt-side surface of the cigarette wrapping paper about the second edge portion.

In some aspects, the tongue 60 is generally manufactured from bronze, carbon steel, stainless steel, or the like. The tongue has a concave filler-contacting surface which is sufficient to form the tobacco filler stream which comes into contact therewith into a rod-like shape having the desired cross-sectional configuration (i.e., shape, dimension, etc.). For typical cigarette rods having a generally circular cross section, the tobacco filler contacting surface of the tongue typically has a generally semi-cylindrical configuration. The filler-contacting surface of the tongue can be surface-treated, if desired. For example, the filler-contacting surface can be treated with a ceramic having a low coefficient of friction. Alternatively, the surface of the tongue can be manufactured from a porous material, such as a sintered metal. In such a manner, liquid which may be fed into the tongue can exit the filler-contacting surface through the composite material. Furthermore, a tongue having suitable bores therethrough can have the filler-contacting surface thereof treated with a porous material. As shown in FIGS. 1 and 2, tongue 60 is supported and maintained in place in the garniture region 40 of the cigarette making machine 10 using cantilever beam member 100.

The wrapping material useful herein can vary, and most conveniently is a cigarette paper wrap of the type commonly used for cigarette rod manufacture. Examples of suitable paper wrapping materials are manufactured from flax fiber and calcium carbonate filler Particular examples of suitable wrapping paper materials may be found, for example, in U.S. Pat. No. 7,234,471 to Fitzgerald et al., which is incorporated herein by reference. Such paper wrapping materials generally are provided as a web in the form of a bobbin. The smokable filler employed for the manufacture of the cigarette rod can vary. The smokable filler generally employed in a cut filler form, which is blended, cased, cut and flavored filler ready for cigarette manufacture. Methods and apparatuses for forming such smokable fillers may be as disclosed, for example, in U.S. Pat. No. 4,574,816 to Rudszinat, which is incorporated herein by reference.

The adhesive material implemented in the manufacture of smoking article rods may vary. For example, a PVA/EVA adhesive material may be implemented in the production of tobacco rods. In some typical cigarette rod manufacturing processes, the PVA/EVA adhesive material may be applied as a single longitudinally-continuous bead (i.e., a longitudinally-extending adhesive line) to the wire-side surface of the first edge portion (i.e., about and longitudinally along the first edge portion) of the wrapping material, between the longitudinally-overlapped first and second edge portions, prior to engaging the longitudinally-overlapped wire-side surface of the first edge portion and felt-side surface of the second edge portions, with the adhesive material therebetween, to form the sealed seam. However, the single bead or line of such a conventional adhesive material may, in some instances, be insufficient to provide a suitably robust seal for the side seam of the tobacco rod. This issue may be exacerbated, in some instances, depending on the nature of the adhesive material being applied and/or the particular type of wrapping material being employed. Certain adhesive materials used in the production of cigarette rods include, for example, polymer-based side-seam adhesives such as RJRT CS 1242, Henkel 32-2052 and H. B. Fuller LP 2934 B. Current organic-based side-seam adhesives include Henkel 71-4153 and 4153M. Other suitable adhesive materials may be found, for example, in U.S. Pat. No. 7,234,471 to Fitzgerald et al., which is incorporated herein by reference.

As such, some particular aspects of the present disclosure implement an adhesive application device 70 configured to apply an adhesive material in the form of one or more longitudinally-continuous beads or lines to the felt-side surface of the cigarette wrapping material about and longitudinally along the second edge portion, between the longitudinally-overlapped first and second edge portions, prior to engaging the longitudinally-overlapped wire-side surface of the first edge portion and felt-side surface of the second edge portions, with the adhesive material therebetween, to form the sealed seam. In yet other aspects, the adhesive application device 70 may be configured to apply one or more longitudinally-continuous beads or lines of an adhesive material to each of the wire-side surface of the cigarette wrapping material about and longitudinally along the first edge portion and to the felt-side surface of the cigarette wrapping material about and longitudinally along the second edge portion, between the longitudinally-overlapped first and second edge portions, prior to engaging the longitudinally-overlapped wire-side surface of the first edge portion and felt-side surface of the second edge portions, with the adhesive material therebetween, to form the sealed seam.

FIG. 5 schematically illustrates one configuration of an adhesive application device 70 that can be implemented for forming smoking articles rods in accordance with aspects of the present disclosure. In one aspect, an additional nozzle or applicator 150 for dispensing the adhesive material to the felt-side surface of the cigarette wrapping material about and longitudinally along the second edge portion may be positioned near the bottom region of the garniture relative to the conventional or original nozzle or applicator 140 of the adhesive application device 70 for applying the adhesive material to the wire-side surface of the cigarette wrapping material about and longitudinally along the first edge portion of the wrapping material. The conventional nozzle/applicator 140 can be positioned and operated as is carried out traditionally. The additional nozzle/applicator 150 can be, for example, positioned lower in the garniture section in a region of the smoking article rod production machine that is a hollow region formed or cut out of the machine to accommodate positioning of the additional nozzle/applicator 150. In other instances, the additional nozzle/applicator 150 may include an elongated nozzle/applicator portion can be positioned so as to apply the adhesive material to the desired region of the paper wrapper/cigarette wrapping material. One skilled in that art will also appreciate that each nozzle/applicator 140, 150 can be configured as a plurality of nozzles/applicators, or as a multiple outlet nozzle/applicator, so as to be capable of applying a plurality of longitudinally-continuous beads or lines of the adhesive material to the wrapping material.

In still other aspects, each nozzle/applicator 140, 150 may be user-selectable such that the application of the adhesive material may vary. For example, such selectability may be desirable depending on the type of adhesive material and/or the type of wrapping material being employed. In other instances, in addition or in the alternative to user-selectable nozzles/applicators, one skilled in the art will appreciate that consistent dispensation of the adhesive material may be accomplished in different manners. For example, in instances, where the tobacco rod production speed or rate may vary, the cigarette making machine 10, or at least the garniture section 40 thereof, may include a rate sensor (not shown) configured to determine an actual production speed or rate for the tobacco rod. A signal from the rate sensor may then be communicated to a controller (not shown) and to a variable speed dispensation pump, or directly to the variable speed dispensation pump (not shown), associated with the source 67 and/or adhesive application device 70 of the adhesive material, such that the application rate of the adhesive material can be correlated (i.e., by varying the speed of the dispensation pump for the adhesive material) with the actual production rate of the tobacco rod, with the actual production rate determined by the rate sensor. In this manner, real time feedback may be employed to control the characteristics of the applied adhesive bead(s) or line(s) as a function of the tobacco rod production rate.

Further, aspects of the present disclosure may be applicable to the formation of different smoking article rods other than the "tobacco rod" example provided herein. For example, aspects of the present disclosure may be implemented in the production of filter rods, wherein the adhesive material may comprise a hot melt adhesive, or in the production of degradable filter rods, wherein the adhesive material may comprise a starch-based adhesive material/hot melt. Accordingly, aspects of the present disclosure may provide or otherwise facilitate the formation of a more robust side-seam in the production of various smoking article rods, for example, by increasing the surface area of the side-seam interacting with the adhesive material and/or by allowing the application of the adhesive material to be optimized according to the type of adhesive material and the nature of the wrapping material to which the adhesive material is applied. Such increased robustness of the side-seam formed by aspects of the present disclosure may, in turn, allow production speeds for the smoking article rods to be increased, for example, to rates of 6000 cigarettes per minute or more.

It will be appreciated that the various aspects, embodiments, implementations and features of the described embodiments may be used separately or in any combination. Moreover, many modifications and other embodiments of the inventions set forth herein will come to mind to one skilled in the art to which these inventions pertain having the benefit of the teachings presented in the foregoing descriptions and the associated drawings. For example, in order to promote or facilitate a robust interaction (i.e., bond) between the adhesive material and the cigarette wrapping material, the cigarette making machine 10, or at least the garniture section 40, may include one or more seam preparation devices 250, 260 configured to interact with the felt-side surface of the cigarette wrapping material about and longitudinally along the second edge portion and/or the wire-side surface of the cigarette wrapping material about and longitudinally along the first edge portion. In such instances, the seam preparation device(s) 250, 260 may be configured, for example, to scuff or roughen the respective wire-side and felt-side surfaces of the cigarette wrapping material/paper about and longitudinally along the first and second edge portions so as to increase the surface area of the cigarette wrapping material/paper interacting with the adhesive material and/or the penetration of the adhesive material with respect to the surface of the cigarette wrapping material/paper. In other instances, the seam preparation device(s) 250, 260 may each comprise, for example, a laser perforation device or an electrostatic perforation device configured to perforate or otherwise increase the porosity of the cigarette wrapping material/paper about and longitudinally along the first and second edge portions, so as to increase or improve penetration of the adhesive material into the cigarette wrapping material/paper.

Therefore, it is to be understood that the embodiments of the invention are not to be limited to the specific embodiments disclosed and that modifications and other embodiments are intended to be included within the scope of the invention. In addition, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

That which is claimed:

1. A method for forming a smoking article rod, comprising:

engaging a continuous stream of a smokable filler material with a first surface of a longitudinally-continuous web of a wrapping material comprising a cigarette wrapping paper, the first surface being a wire-side surface of the cigarette wrapping paper, the web having laterally-opposed first and second edge portions extending along the longitudinally-continuous web, and having a second surface opposing the first surface, the second surface being a felt-side surface of the cigarette wrapping paper;

longitudinally wrapping the web of the wrapping material about the smokable filler material such that the wire-side surface about the first edge portion extends over the felt-side surface about the second edge portion, and so as to contain the smokable filler material within the longitudinally-continuous web; and applying an adhesive material dispensed from a first applicator to the wire-side surface about and longitudinally along the first edge portion and applying the adhesive material dispensed from a second applicator to the felt-side surface about and longitudinally along the second edge portion separately and discretely from the adhesive material applied to the wire-side surface, prior to engaging the wire-side surface of the first edge portion and felt-side surface of the second edge portion, with the separate and discrete applications of the adhesive material dispensed from the first and second applicators disposed therebetween, to form a sealed seam and produce a longitudinally-continuous smoking article rod.

2. The method of claim 1, wherein engaging a continuous stream of a smokable filler material comprises engaging a continuous stream of a tobacco material with the first surface of the longitudinally-continuous web of the wrapping material.

3. The method of claim 1, wherein applying the adhesive material dispensed from the first applicator to the wire-side surface about and longitudinally along the first edge portion and dispensed from the second applicator to the felt-side surface about and longitudinally along the second edge portion comprises applying the adhesive material dispensed from the first applicator to the wire-side surface about and longitudinally along the first edge portion and dispensed from the second applicator to the felt-side surface about and longitudinally along the second edge portion so as to form separate and discrete parallel adhesive beads extending along the wire-side surface of the first edge portion and along the felt-side surface of the second edge portion of the longitudinally continuous web, such that engagement of the wire-side surface of the first edge portion and felt-side surface of the second edge portion with the separate and discrete parallel adhesive beads therebetween forms the sealed seam between and with the first and second edge portions.

4. The method of claim 1, comprising heating or cooling the adhesive material prior to applying the adhesive material to at least the second surface.

5. The method of claim 1, comprising roughing the first or second surface prior to applying the adhesive material to at least the second surface.

6. The method of claim 1, comprising increasing porosity of the first or second surface prior to applying the adhesive material to at least the second surface.

7. The method of claim 6, wherein increasing porosity of the first or second surface comprises laser perforating or electrostatically perforating the first or second surface prior to applying the adhesive material to at least the second surface.

8. An apparatus for forming a smoking article rod, comprising:

a forming device configured to engage a continuous stream of a smokable filler material with a first surface of a longitudinally-continuous web of a wrapping material, the first surface being a wire-side surface of the cigarette wrapping paper, the web having laterally-opposed first and second edge portions extending along the longitudinally-continuous web, and having a second surface opposing the first surface, the second surface being a felt-side surface of the cigarette wrapping paper;

a wrapping device configured to longitudinally wrap the web of the wrapping material about the smokable filler material such that the wire-side surface about the first edge portion extends over the felt-side surface about the second edge portion, and so as to contain the smokable filler material within the longitudinally-continuous web; and an adhesive applicator device including a first applicator configured to apply an adhesive material to the wire-side surface about and longitudinally the first edge portion and a second applicator configured to apply the adhesive material to the felt-side surface about and longitudinally along the second edge portion separately and discretely from the adhesive material applied to the wire-side surface by the first applicator, prior to the wrapping device engaging the wire-side surface of the first edge portion and the felt-side surface of the second edge portion, with the separate and discrete applications of the adhesive material dispensed from the first and second applicators disposed therebetween, to form a sealed seam and produce a longitudinally-continuous smoking article rod.

9. The apparatus of claim 8, wherein the forming device is configured to engage the continuous stream of the tobacco material with the first surface of the longitudinally-continuous web of the wrapping material.

10. The apparatus of claim 8, wherein the first applicator of the adhesive applicator device is configured to apply the adhesive material to the wire-side surface about and longitudinally along the first edge portion and the second applicator is configured to apply the adhesive to the felt-side surface about and longitudinally along the second edge portion, so as to form separate and discrete parallel adhesive beads extending along the wire-side surface of the first edge portion and along the felt-side surface of the second edge portion of the longitudinally continuous web, such that the wrapping device engaging the wire-side surface of the first edge portion and felt-side surface of the second edge portion with the separate and discrete parallel adhesive beads therebetween forms the sealed seam between and with the first and second edge portions.

11. The apparatus of claim 8, comprising a temperature control arrangement configured to heat or cool the adhesive material prior to the adhesive material being applied by the adhesive applicator device to at least the second surface.

12. The apparatus of claim 8, comprising a seam preparation device configured to roughen the first or second surface prior to the adhesive material being applied by the adhesive applicator device to at least the second surface.

13. The apparatus of claim 8, comprising a seam preparation device configured to increase porosity of the first or second surface prior to the adhesive material being applied by the adhesive applicator device to at least the second surface.

14. The apparatus of claim 13, wherein the seam preparation device comprises a laser perforation device or an electrostatic perforation device configured to perforate the first or second surface.

15. A method for forming a smoking article rod, comprising:

longitudinally wrapping a longitudinally-continuous web of a wrapping material comprising a cigarette wrapping paper, a first surface of the longitudinally- continuous web of the cigarette wrapping paper being a wire-side surface and having a continuous stream of a smokable filler material engaged therewith, such that the wire-side surface about a first edge portion extends over a second surface of the longitudinally-continuous web of the cigarette wrapping paper, the second surface being a felt-side surface, about a second edge portion laterally opposed to the first edge portion, the felt-side surface opposing the web-side surface, and so as to contain the smokable filler material within the longitudinally-continuous web; and applying an adhesive material dispensed from a first applicator to the wire-side surface about and longitudinally along the first edge portion and applying the adhesive material dispensed from a second applicator to the felt-side surface about and longitudinally along the second edge portion separately and discretely from the adhesive material applied to the wire-side surface by the first applicator, prior to engaging the wire-side surface of the first edge portion and felt-side surface of the second edge portion, with the separate and discrete applications of the adhesive material dispensed from the first and second applicators disposed therebetween, to form a sealed seam and produce a longitudinally-continuous smoking article rod.

16. An apparatus for forming a smoking article rod, comprising:

a wrapping device configured to longitudinally wrap a longitudinally-continuous web of a wrapping material comprising a cigarette wrapping paper about a continuous stream of a smokable filler material engaged with a first surface of the longitudinally-continuous web of the wrapping material, such that the first surface about a first edge portion extends over a second surface of the longitudinally-continuous web of the wrapping material about the second edge portion laterally opposed to the first edge portion, the first surface being a wire-side surface and the second surface opposing the first surface and being a felt-side surface, and so as to contain the smokable filler material within the longitudinally-continuous web; and an adhesive applicator device configured to apply an adhesive material dispensed from a first applicator to the wire-side surface about and longitudinally along the first edge portion and to apply the adhesive material dispensed from a second applicator to the felt-side surface about and longitudinally along the second edge portion separately and discretely from the adhesive material applied to the wire-side surface by the first applicator, prior to the wrapping device engaging the wire-side surface of the first edge portion and felt-side surface of the second edge portion, with the separate and discrete applications of the adhesive material dispensed from the first and second applicators disposed therebetween, to form a sealed seam and produce a longitudinally-continuous smoking article rod.

* * * * *